United States Patent [19]

Adamski, Jr. et al.

[11] 4,248,170

[45] Feb. 3, 1981

[54] AUXILIARY FEED MECHANISM FOR SEWING MACHINES

[75] Inventors: Maximilian Adamski, Jr., Wheeling; Robert C. Talsma, Glen Ellyn; Robert L. Kosrow, Hoffman Estates; Benjamin T. Bernstein, Highland Park, all of Ill.

[73] Assignee: Union Special Corporation, Chicago, Ill.

[21] Appl. No.: 966,460

[22] Filed: Dec. 4, 1978

Related U.S. Application Data

[63] Continuation-in-part of Ser. No. 833,110, Sep. 14, 1977, Pat. No. 4,147,120.

[51] Int. Cl.[3] ..... D05B 27/12; D05B 21/00

[52] U.S. Cl. ..... 112/318; 112/121.11; 112/121.26; 112/306

[58] Field of Search ..... 112/121.26, 211, 210, 112/208, 203, 121.12, 121.11, 214, 124 R, 153, 305, 306, 312, 318, 121.27, 150; 226/17, 50, 16; 242/57.1; 271/227, 250

[56] References Cited

U.S. PATENT DOCUMENTS

| | | | |
|---|---|---|---|
| 2,979,745 | 4/1961 | Schaefer, Jr. et al. | 112/211 |
| 3,080,836 | 3/1963 | Clemens et al. | 112/121.12 X |
| 3,232,256 | 2/1966 | Buckalter | 112/306 X |
| 3,417,718 | 12/1968 | Andersson | 112/203 |
| 3,472,187 | 10/1969 | Kaplan et al. | 112/203 X |
| 3,609,373 | 9/1971 | Pesai | 112/121.11 X |
| 3,867,889 | 2/1975 | Conner, Jr. | 112/121.11 |
| 3,925,713 | 12/1975 | Richmond | 112/121.11 X |
| 3,954,071 | 5/1976 | Mall et al. | 112/153 X |
| 3,980,032 | 9/1976 | Kleinschmidt et al. | 112/121.11 X |
| 3,994,247 | 11/1976 | Cummins | 112/210 |
| 4,098,201 | 7/1978 | Adamski, Jr. et al. | 112/153 |
| 4,109,595 | 8/1978 | Ducol et al. | 112/208 X |
| 4,147,120 | 4/1979 | Adamski, Jr. et al. | 112/121.12 |

*Primary Examiner*—Werner H. Schroeder
*Assistant Examiner*—A. Falik
*Attorney, Agent, or Firm*—John W. Harbst; John A. Schaerli

[57] ABSTRACT

The disclosed invention relates to an auxiliary feed mechanism adapted to maintain an edge of a workpiece in substantial registration with a predetermined path along which the workpiece edge is moved. The invention includes a motor driven auxiliary feed device which is operatively associated with a unique servosystem. The invention further includes sensing elements arranged to monitor the position of the workpiece edge and devices operatively associated with the sensing elements and the servosystem for automatically adjusting the feed rate of the auxiliary mechanism according to the characteristics of the work being sewn and for effecting the speed of the auxiliary mechanism relative to the velocity of the workpiece whereby maintaining the desired alignment of the workpiece edge relative its predetermined position or path during the sewing operation.

25 Claims, 12 Drawing Figures

SPEED
TIME
C
F
D
B
E
A
$t_1$
$t_2$
$t_2$
$t_3$
215
217

175
173
174
208
178
182
108
A
B
FF2
200
210
180
176
110
202
FF1
196
195
172
204
198
206

AUXILIARY FEED MECHANISM FOR SEWING MACHINES

CROSS REFERENCES

This application is a Continuation-In-Part of application Ser. No. 833,110 filed Sept. 14, 1977 U.S. Pat. No. 4,147,120.

BACKGROUND OF THE INVENTION

This invention represents an improvement over such apparatus as disclosed in U.S. Pat. No. 4,098,201 issued July 4, 1978 to M. Adamski, Jr. et al. However, this invention is equally applicable, at least in part, to other types of machines which are adapted to operate on the edge of a workpiece.

The present invention relates to sewing machines and more particularly to an auxiliary feed mechanism which is capable of being attached to existing machines for feeding a workpiece past a work station of the machine where operations are performed thereon.

It is recognized that it may be desirous in some operations to aid the feed mechanism of the machine in continually advancing the workpiece through the work station and, in some instances, to continue running after the machine stops in order to pull the material through the machine. It may also be a common desire in some sewing operations to intermittently alter the speed of the machine so as to gather or stretch the fabric plies and then return the sewing machine to its normal or regular operating speed. While the present invention may be capable of performing these operations and others, for purposes of this description the present invention will be described for and in terms of an apparatus as applied to a stitching machine of the type described in the above identified patents wherein a blindstitch hem is secured about the edge of a tubular garment such as a T-shirt.

As one skilled in the art may appreciate, in hemming tubular workpieces it is necessary to carefully control the position of the workpiece edge relative the workstation of the machine. With the machine described in the above identified patent, that portion of the workpiece to be hemmed is rotated in a true circle. However, at the onset of the sewing cycle a portion of the workpiece immediately rearward of the presser foot may be laterally displaced relative the portion of the edge in advance of the stitch forming area. In view of the circular rotation of the raw edge and so as to aid in advancing and guiding the workpiece through the machine, means are provided for realigning and maintaining the workpiece edge within certain limits.

The industrial sewing machine industry has consistently sought ways by which an auxiliary feed action may be placed upon the workpiece as the latter is fed through the stitching area of the machine. It has been known in industrial type sewing machines to impart a concomitant feeding motion to the workpiece by use of a puller mechanism assembly which assists the sewing head during the sewing operation. Attempts have been made by using pullers which include upper and lower (top and bottom) rollers which contact the fabric after sewing so as to pull the workpiece through the sewing station. As is apparent, if any puller mechanism is going to aid in advancing the workpiece it is required to move slightly in excess of the speed of the feed mechanism of the machine. However, the excess speed requirement sometimes requires the use of additional mechanisms so as to achieve the desired ratio as well as to allow adjustment of said ratio.

Such devices known for concomitantly feeding the workpiece in relation with the feed mechanism of the machine have the disadvantage of usually requiring cumbersome supports and guides which are normally situated about the sewing head so as to derive power therefrom. This leads to another disadvantage, in that the higher speeds of today's machines require a minimum of loading to be placed on the machine so that quick acceleration and higher speeds may be achieved. As mentioned above, and as should be apparent, auxiliary feed mechanisms are usually set to run faster than the speed at which the feed mechanism is advancing the material workpiece but unless this quicker speed is calculated quite carefully, undesired gathering of the material workpiece may result. In this regard, the lack of an adequate adjustability factor is yet another drawback in the heretofore known devices. That is, once the speed of the auxiliary feed mechanism has been adjusted it has not been possible to readily vary the speeds of said mechanism during sewing. Further with the heretofore known devices the speed of the auxiliary feed mechanism is usually not fully developed until the sewing machine has attained its full or required speed. But, whereas it is desirous to achieve the full speed of the auxiliary feed mechanism concurrent with the speed of the machine so as to advance the workpiece in conjunction with the speed of the feed mechanism. It has also been known to provide means in front of the stitching devices for forcibly urging the workpiece edge into alignment with a predetermined position. As one will appreciate, the forceful urging of workpiece edge in close proximity to the stitching device without some regard to the speed of the feed mechanism may cause puckering or uneven seams. For the reasons discussed hereinabove, the art heretofore known does not readily lend itself to the application required with the machine shown in the above identified patent.

In addition, it may be interesting to note that the same or seemingly similar types of material may sew quite differently depending on variations in the finish of the workpiece, it's color and possibly even if it has been compacted in storage. Although these variations may not matter a great deal in a conventional sewing operation, they may affect the operation of the bottom hemmer due to its automatic rather than manual operation. Therefore, it was necessary to provide means which could quickly and easily compensate for any variances in the workpieces being sewn.

SUMMARY OF THE INVENTION

In view of the above, and in accordance with the present invention there is provided an auxiliary feed mechanism which serves the purpose of concomitantly aiding the feed mechanism of the machine and is capable of maintaining the workpiece edge in substantative alignment with a predetermined path of travel. Further, the present invention has the capability of sensing the type of workpiece being sewn and adjusting the relative feed rates accordingly.

The auxiliary feed mechanism according to this invention includes a feed device which is operative to colinearly advance the workpiece in timed relation with the advancement of same by the main feed mechanism of the machine. In the preferred embodiment the feed device is operable to move between operative and inoperative positions. A bracket means is provided for moving the feed device between its respective positions. Operably associated with the bracket is a drive force member which responds to the logic circuitry of the machine so as to move the feed device in proper sequence to the sewing operation. A plurality of flexible couplings are employed to connect the feed device with a servomotor which is synchronously but yet independently associated with the main drive motor of the machine through a unique electrical circuit or servosystem arrangement. Through the use of a servomotor the driving force for the auxiliary feed mechanism, which has traditionally been transmitted from the sewing machine head, has now an independent source of power so as to alleviate forces from the sewing head and in this way it may be possible to maintain the higher speeds required of today's sewing operations.

As noted above, at the onset of the stitching operation a portion of the workpiece on the downstream side of the presser foot is laterally displaced. It has been found that the lateral placement of the edge of the workpiece may be varied or compensated for by adjusting the feed rate of the auxiliary mechanism relative the feed rate of the machine. In this regard, the servosystem of the present invention is adapted to control the speed of the servomotor such that the feeding rate of the auxiliary feed mechanism can be adjusted to run faster, slower, or equal to the feeding rate of the main feed mechanism as is required. The variance in the feed rate velocities results in a tension or component force vector being placed on that portion of the workpiece situated between the presser foot and the auxiliary feed mechanism and it is this tension or component force vector which causes the laterally displaced edge to be drawn back to its proper path.

So as to maintain the edge of the workpiece within a predetermined range, sensor elements are arranged to monitor the position of the workpiece edge. The servosystem of the present invention is responsive to the sensors and, if necessary, is adapted to vary the speed of the auxiliary feed advancing mechanism so as to urge the edge of the workpiece toward its predetermined path.

As noted above, it has been found that the feeding characteristics of different materials vary and, accordingly, must be compensated for. It may be expected that a change in the characteristics of a workpiece or machine without a corresponding complimentary change in the feed rate of the auxiliary feed mechanism may cause the material to traverse along a path different from the previously sewn workpiece. One feature of this invention is based on this observation and is characterized in that the machine may learn from the first garment or two what adjustments to the feed rate of the auxiliary feed mechanism are necessary so as to compensate for any changes in the characteristics of the workpiece or machine and then to automatically make those adjustments so that the remainder of the garments may be fed without further adjustments. Thus, there is greater flexiblity of the apparatus to respond to the existance of the garments having different characteristics.

There is also provided, in accordance with the present invention, means which "track" the speed of the sewing machine. The term "tracking" throughout the specification here to follow means that the main drive motor and the servomotor both produce output signals. These output signals are received at the summing point in the servosystem which, in turn, produces a control signal that adjusts or changes the speed of the servomotor as a function of the speed of the main drive motor. Accordingly, when the main drive motor of the machine increases or decreases in speed, the speed of the auxiliary feed mechanism is also directly effected by said change. It is also possible by means incorporated within the servosystem to easily adjust the relative feed ratios of the feed mechanisms than has been heretofore known in the art.

In view of the above, a primary object of this invention is to provide an auxiliary feed mechanism for a sewing machine which may be independent of the mechanization of the sewing machine.

Another object of this invention is the provision of an auxiliary feed mechanism which has the capability of varying its rate of feed relative to the velocity of the workpiece during the sewing cycle.

Another object of this invention is to provide an auxiliary feed mechanism which can be used concomitantly with the feed mechanism of the machine but yet disposed remote therefrom.

Yet another object of the present invention is the provision of an auxiliary feed mechanism which is independently electrically operated.

Still a further object of this invention is to provide an auxiliary feed mechanism having means which are capable of sensing and correcting for lateral deviation of the edge of the workpiece from a predetermined position.

Another object of the present invention is the provision of an auxiliary feed mechanism which is capable of automatically adjusting to varying characteristics of the workpiece or machine.

Still a further object of this invention is to provide an auxiliary feed mechanism which is accurate and reliable in operation.

Yet a further object of this invention is to provide an auxiliary feed mechanism capable of very rapidly being mounted on a conventional sewing machine by a relatively unskilled person.

Still a further feature of the present invention is the provision of an attachment as aforesaid, for use with material handling systems and machines other than industrial sewing machines.

Yet another object of the present invention is to provide an auxiliary feed mechanism which is relatively inexpensive and which will operate relatively efficiently and in synchronous response to the relative high speeds of the machine.

These features and other features of this invention will be pointed out in further detail in the following description according to a preferred, but not exclusive embodiment given merely as an example and not restrictively in the attached drawings.

BRIEF DESCRIPTION OF THE DRAWINGS

The invention is illustrated by way of example in the accompanying drawings which form part of this application and in which.

DESCRIPTION OF THE PREFERRED EMBODIMENT

Figure 1:
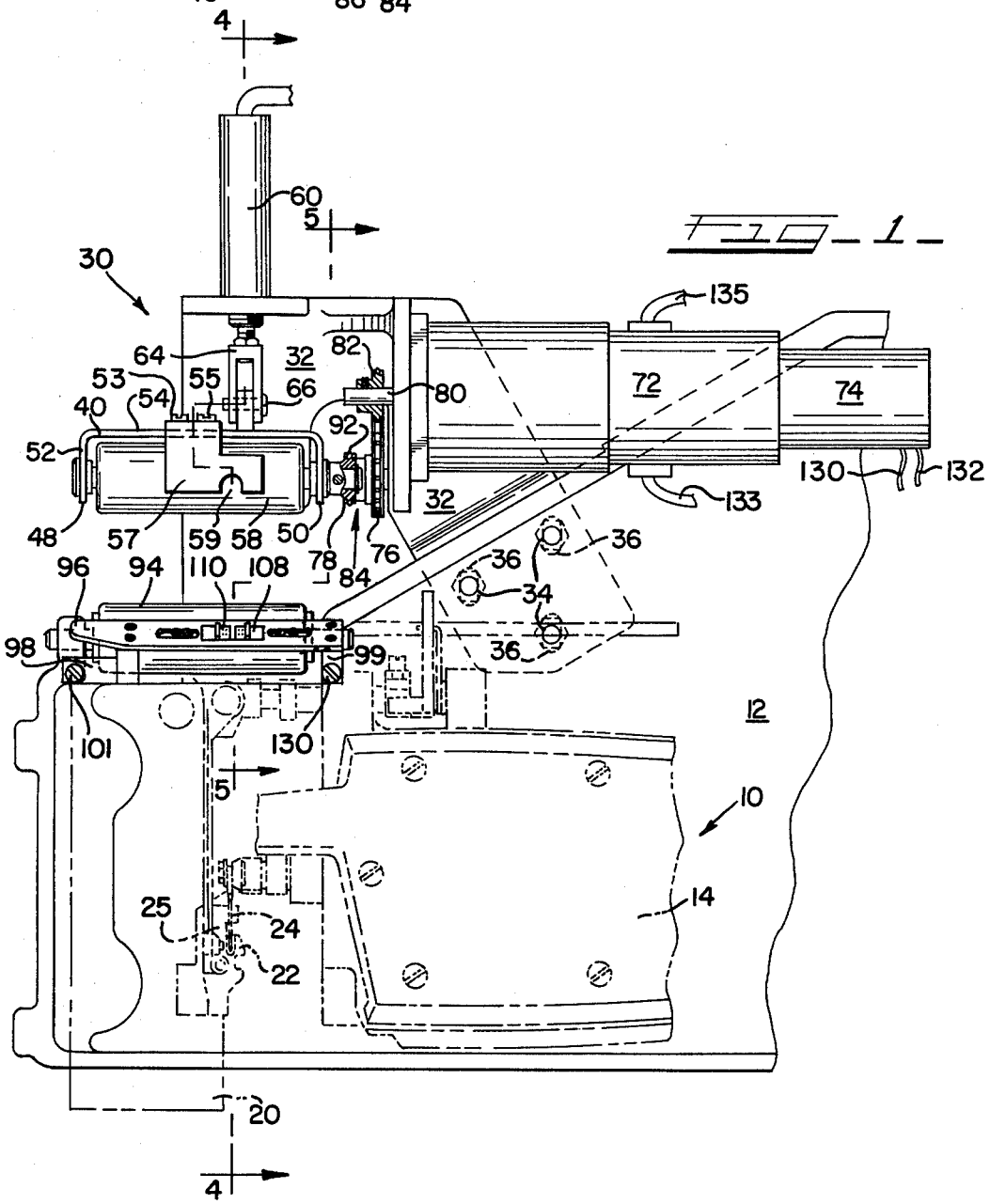
FIG. 1 is a partial top plan view showing the present invention as attached to the frame of the machine.
Figures 3, 5:
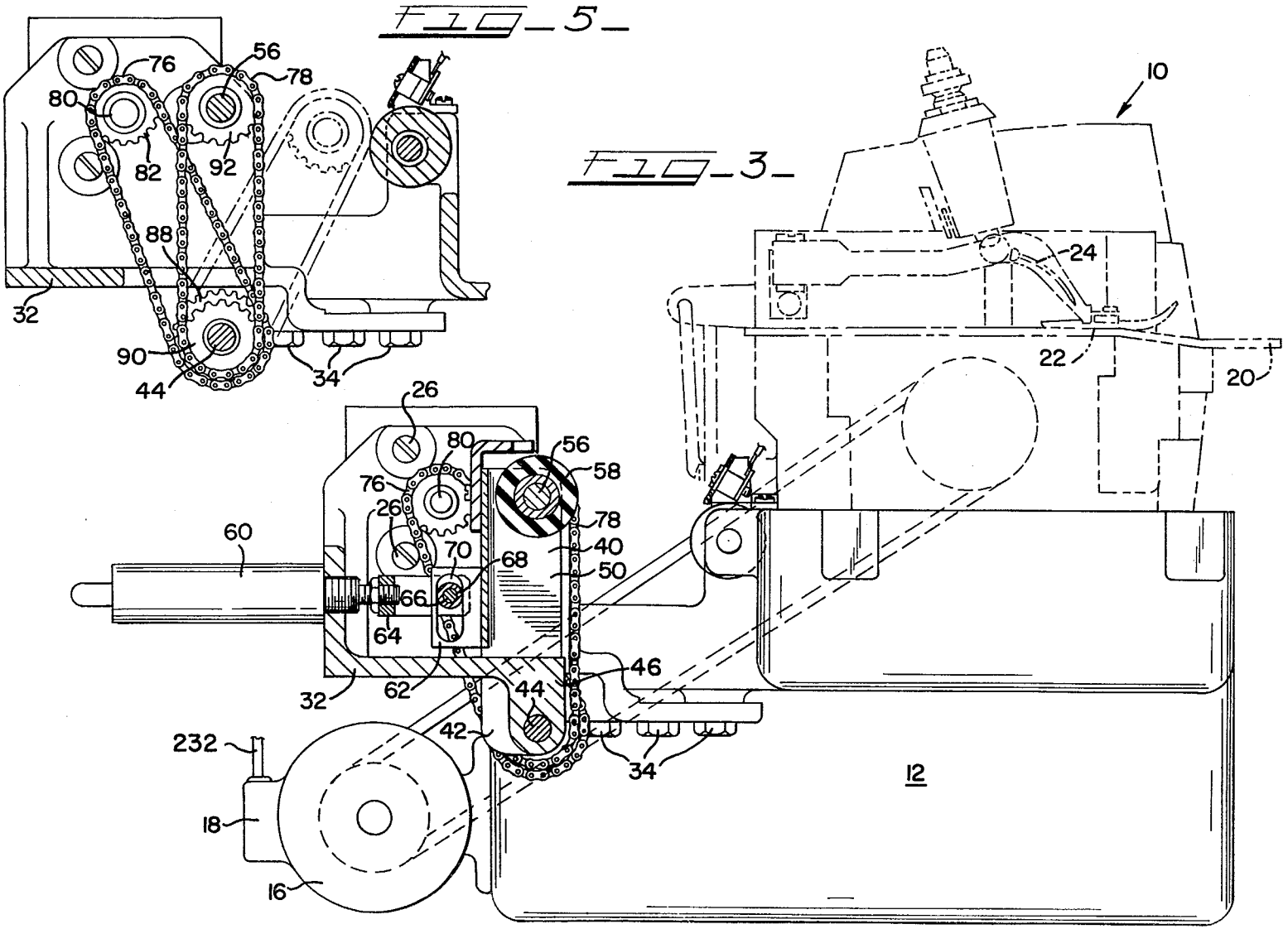
FIG. 3 is a side view, taken partially in section, of the present invention showing the auxiliary feed mechanism in a nonoperative position.
FIG. 5 is a partial cross sectional view taken along line 5—5 of FIG. 1 and showing in phantom lines the different positions of which the present invention is capable of moving.
Figure 4:
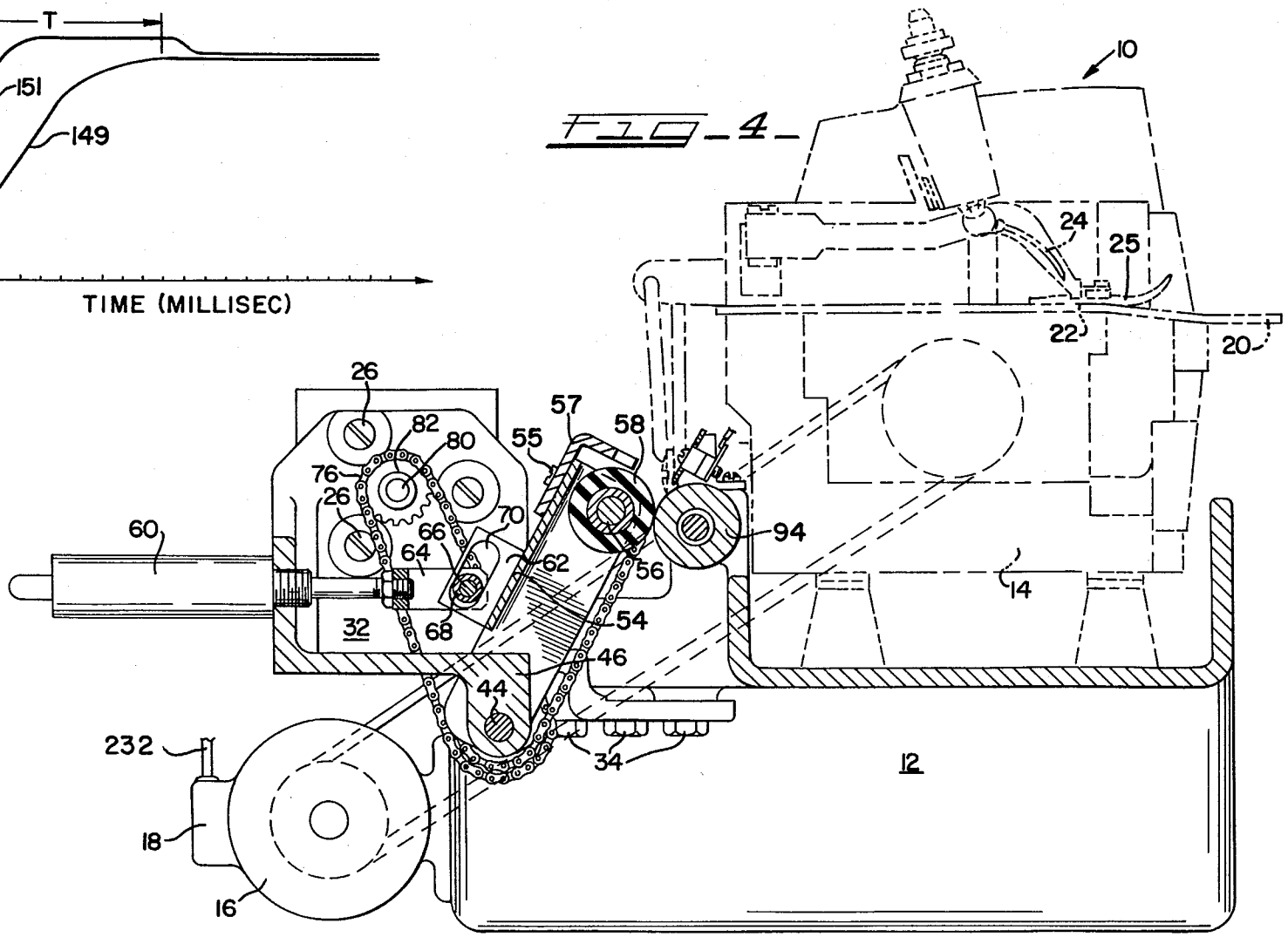
FIG. 4 is a side elevational view taken along line 4—4 of FIG. 1 and showing the auxiliary feed mechanism in its operative position.

Referring now in more detail to the drawings in which like reference numerals indicate like parts throughout the several views, the present invention, as shown in FIGS. 1, 3 and 4, depicts, partially in phantom lines, a conventional sewing machine 10 which is supported on a table or support 12. The machine includes a frame 14 and a main drive motor 16 for driving said machine. The main drive motor 16 is a commercial apparatus such as a Quick 880 motor which may be modified somewhat for the particular operation. The motor 16 is provided with suitable electronic sensing means 18 which is adapted to produce electric impulses or signals representative of the speed of the motor 16. This apparatus is commercially available and is mentioned here only for the purpose of adequately describing certain additions which follow. The sewing machine 10 further includes a work support 20 which may be hingedly connected to the frame 14 and is adapted to hold the workpiece in position for subsequent penetration at a stitching point generally indicated as 22 and which is defined by the path of the reciprocating needle means 24. The sewing machine 10 still further includes a presser foot 25 and a feed mechanism means (not shown) which is well known in the art as is apparent from viewing U.S. Pat. No. 2,704,042 granted Mar. 15, 1955 to N. L. Wallenberg et al. While the details of the feed mechanism are omitted as not forming part of the present invention, and being explicitly illustrated in the U.S. Pat. No. 2,704,042 patent, suffice it to say that relative the auxiliary feed mechanism of the present invention the main feed mechanism is such that it retards or constrains the movement of the workpiece. From the art herein cited, it is apparent that the sewing machine and associated mechanisms are well known and therefore no further description will be devoted thereto. Further, the sequential logic operation for a machine of this sort and related electrical circuitry for automatically controlling the operation of the sewing cycle are described in the above mentioned Adamski, Jr. patent, incorporated herein by reference and thus no further description will be devoted thereto.

Figure 2:
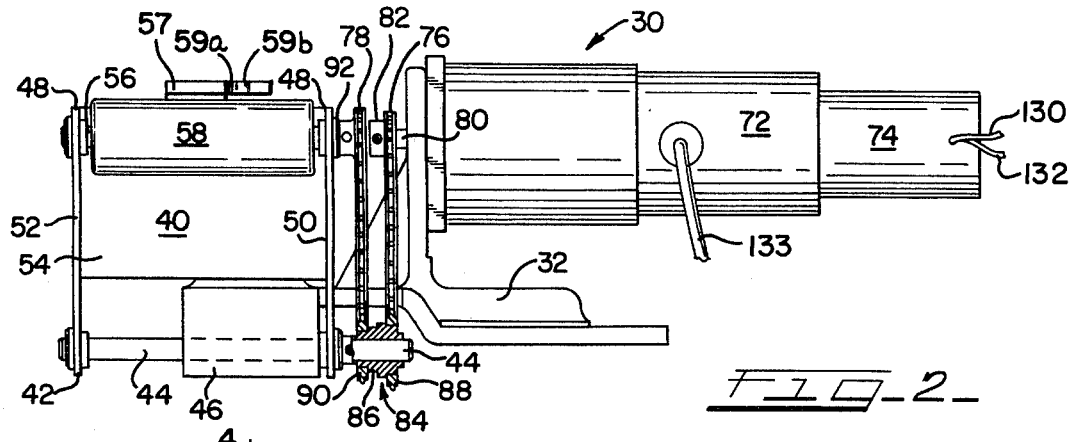
FIG. 2 is a front elevational view showing the present invention as removed from the frame of the sewing machine.

Turning to FIGS. 1 and 2, the auxiliary feed mechanism generally indicated by the reference numeral 30, includes a mounting or support means 32 for various components and elements of the mechanism 30 and which may be secured to the table 12 by any suitable means such as 34. The mounting means 32 is provided with elongated slots 36 so that the entire auxiliary feed mechanism 30 may be adjusted relative the machine 10 if necessary. In the presently preferred embodiment, the auxiliary feed mechanism is provided with a feed device 58 which may be moved between operative and inoperative positions. However, it should be appreciated that with only minor changes in design it would also be possible to provide two drive members for imparting motion to the workpiece. So as to allow movement of the feed device while still maintaining the relationship of the feed roller to the direction of feed stationary, and as shown in FIGS. 2 and 3, the illustrated invention is provided with a bracket means 40 which may be secured at its first end 42 to the support means 32 by means of a freely rotatable elongated shaft 44 which is received in a depending lug 46 forming part of the mounting means 32. The bracket 40 includes a pair of opposed sidewalls 50 and 52 which are joined to each other by another wall 54. Rotatably mounted at the second end 48 of the bracket 40 is a second elongated freely rotatable shaft 56 which carries the drive member or feed device 58 which in the preferred embodiment is in the form of a feed roller. In the embodiment shown, the position of the feed device 58 is such that it is adapted to impart a motion to the workpiece which is both concomitant and colinear or parallel with the motion of the main feed mechanism of the machine.

Reciprocation of the bracket 40 about the horizontal axis of shaft 44 is accomplished by actuation/deactuation of a force driver 60 which may be in the form of a pneumatic cylinder. Suitable connections are provided for rocking the bracket 40 and thereby causing the feed roller 58 to move between its inoperative position shown in FIG. 3. and its operable position shown in FIG. 4. The suitable connections for operably connecting the force driver 60 with the bracket 40 include a member 62 which is secured to the wall 54 of bracket 40. As shown, the driving end 64 of the force driver 60 carries a pin 66 and a hollow roller element 68 which may be slideably received in an elongated slot 70 formed in member 62. The slot 70 allows for a slight sliding movement of the roller element 68 toward the top and bottom of the slot 70, as seen in FIGS. 3 and 4, as the bracket is rocked through a suitable angle so as to move the drive member 58 into its operative position (FIG. 4). It should be noted that the force driver 60 is interconnected with the logic system of the automatic machine 10 so that the feed device may be moved into engagement with the workpiece in timed relation with the sewing cycle of the machine.

Adjustably mounted on wall 54 of bracket 40 by means of screws 53 and 55 is a visual indicator or guide 57 which may be L shaped. As indicated at 59, one arm of the guide is provided with a slot 59 which may be generally aligned with the predetermined path traversed by the workpiece edge during the sewing operation. The opposed sidewalls 59*a* & *b* of the slot permits the operator to quickly view and easily assess if the auxiliary mechanism is operating effectively in positioning the workpiece edge relative its predetermined path.

As seen in FIGS. 1 and 2, secured to the mounting means 32 by any suitable means such as 26 (FIG. 3) is a servomotor 72. The servomotor of the present invention is a commercially available unit such as an Electro- Craft motor, Model No. E586 and is adapted to impart motion to the feed roller 58 in a manner described hereinafter. Operably associated with the motor 72 is a sensing means 74 which, in the preferred embodiment is in the form of a tachometer means. The sensing means 74 includes means adapted to produce electrical signals or impulses which are representative of the speed of the motor 72.

So as to allow reciprocatory movement of the bracket 40 without a loss of force transfer between the motor 72 and the feed roller 58, first and second couplings 76, 78, respectively, have been provided. As is best seen in FIGS. 1, 2 and 5, the servomotor 72 is provided with an output shaft 80 which has secured thereto a sprocket 82 which is the first in a series of sprockets. A freely rotatable assemblage 84 is mounted for rotation on that portion of the shaft 44 which extends to the right of the bracket 40 as seen in FIG. 2. The freely rotatable assemblage 84 includes a stepped bushing 86 which serves to mount the second and third sprockets 88 and 90 respectively. Entrained about the sprockets 82 and 88 is a first endless flexible coupling 76 which is adapted to rotate the assemblage 84 upon actuation of the motor or drive means 72. A fourth sprocket 92 is carried on that portion of the elongated shaft 56 which extends to the right of bracket 40. Entrained about the sprockets 90 and 92 is a second endless flexible coupling 78. Thus, the rotation of the sprocket 82 by the motor 72 may be translated through the flexible couplings 76 and 78 to rotational movement of the feed device 58. Hence, it may be possible to pivot the feed device 58 from the solid line position shown in FIG. 5 to the phantom line position without a loss of force transfer between the motor 72 and the feed device 58 due to the flexibility built in the system by the couplings 76 and 78. In addition, because of the sprockets and chain the speed of the tachometer and motor retain a fixed, nonvarying relationship to the speed of the auxiliary mechanism. This may not be possible with unsprocketed mechanisms.

It should be noted from FIGS. 3 and 4 that in the preferred embodiment the feed roller 58 is mounted for movement in a generally horizontal plane beneath the work support 20 of the machine 10. However, it may be further appreciated that the present invention is equally applicable to a machine wherein it is desired to mount the feed device 58 for operable association with the work support 20 of the machine without derivation from the scope of contribution of the present invention to the appropriate art. In view of the fact that the present invention may utilize a feed roller which is mounted beneath the work support of the machine it has been found preferable to employ a second roller 94 which may be fixedly secured for rotation and arranged so that as the material workpiece drops from the work support 20 it is passed between the feed roller 58 and 94.

Figure 7:
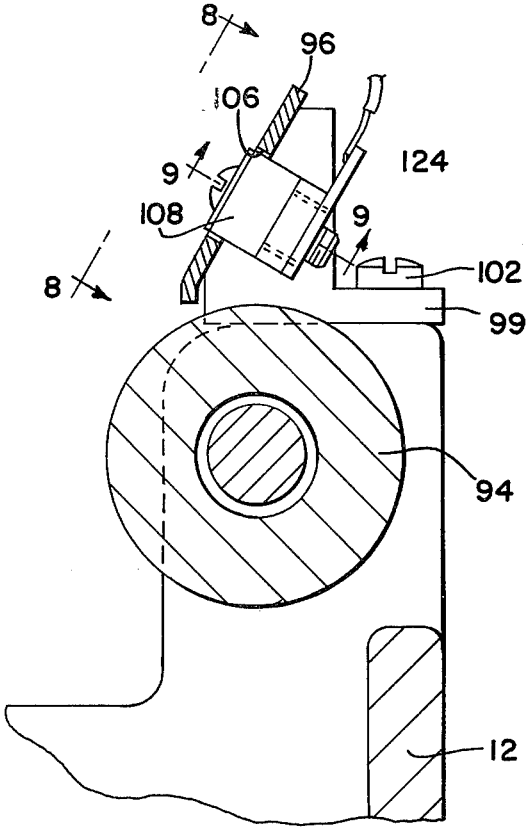
FIG. 7 is an enlarged fragmentary end view, taken in section, of the feed roller and sensing means of the present invention.
Figure 8:
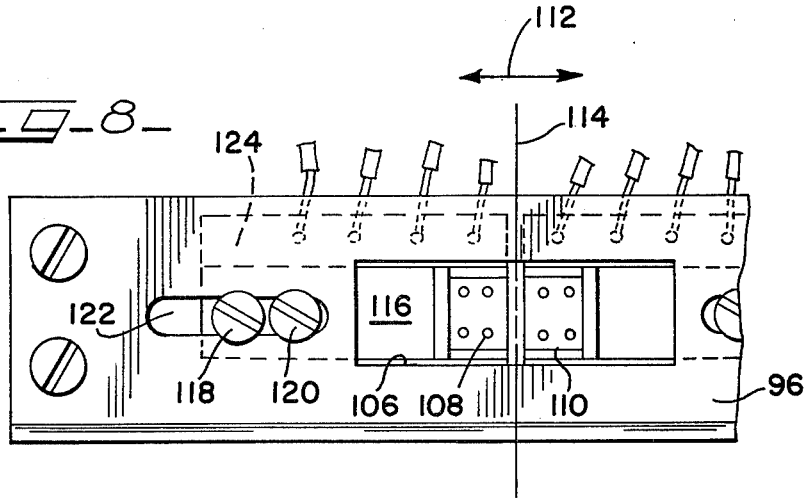
FIG. 8 is a fragmentary top plan view taken along line 8—8 of FIG. 7.
Figure 9:
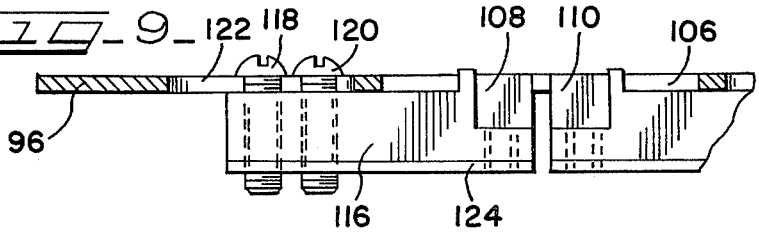
FIG. 9 is a fragmentary elevational view taken along line 9—9 of FIG. 7 of the sensing means forming part of the present invention.

An auxiliary work plate or support 96 is provided rearward of the sewing area, in the direction of feed, a slight distance above the roller 94. The auxiliary plate may be held in position by mounting blocks 98 and 99 which are secured to the support 12 by any suitable means such as 101 and 102 respectively. As best seen in FIGS. 7, 8 and 9 intermediate its ends the plate is provided with an opening 106 which is adapted to receive a series of sensor elements 108 and 110 which, for purposes of this description, may be labeled "too fast" and "too slow" sensors respectively. As described hereinafter, the sensors are arranged to provide a sewing guidance signal indicative of the position of the workpiece edge and are adapted to aid in controlling the lateral deviation of the workpiece caused by any or all of the following: forceable displacement of the edge, a change in stitch length, or a change in the color or texture of the workpiece being sewn. For the moment, suffice it to say that the sensors are adapted to monitor the position of the edge in the direction of the arrow 112 (FIG. 8) relative some predetermined position or path indicated generally by line 114. It will be appreciated that when the workpiece edge is generally in registration with its predetermined path of travel, the sensor 110 is fully covered and sensor 108 is not covered by the material. The sensor means 108, 110 may be either pneumatic or electrical; however, in the preferred embodiment the type known as photo reflective sensors are used. A commercially available sensor which has been found to yield the desired result is that sold by Sensor Technology, Inc. under Part No. STRT 850B/F. Due to the lateral lenght of the opening 106 provision is made for adjusting the lateral position of the sensors relative one another and relative the predetermined path 114 such that the distance between the sensors defines a predetermined range which may be traversed by the edge of the sewn hem without any effect on the speed of the auxiliary mechanism.

The adjustable mounting for the sensors is shown in greater detail in FIGS. 8 and 9. Since both sensors and associated structure may be substantially the same, the sensor 108 will be described as representative in connection with FIGS. 8 and 9. As shown, the sensor 108 may be secured to or carried by the mounting bracket 116 associated therewith. In turn, the associated bracket may be secured to the undersurface of the auxiliary plate 96 by fasteners 118 and 120 which may be adapted to pass through an elongated aperture 122 formed in the plate 96. Thus, the associated bracket and sensor may be laterally adjustable relative the predetermined path 114 for a distance equal to the length of the aperture 122. Secured to the underside of the mounting bracket 116 is a PC Board 124 which connects the associated sensor to a portion of the electrical circuitry of servosystem of the present invention.

Thus far there has been described a physical arrangement of sensor devices and a feed advancing mechanism which maybe located with respect to the feed path of a workpiece and which combine to advance and control the movement of a workpiece while maintaining the lateral deviation of its edge within a predetermined range. There will now be described a unique electrical circuit or servosystem 100 which is associated with the present invention.

As mentioned above, operably associated with the servomotor 72 is a sensing or tachometer means 74 which is adapted to produce output signals or impulses representative of the speed of the auxiliary feed mechanism 30. The impulses from the tachometer are delivered to the servosystem 100, shown in FIG. 10 A over lines 130 and 132. The logic circuitry for controlling operation of the sewing cycle, incorporated herein by reference from the above identified Adamski, Jr. patent, may be delivered to the servosystem of this invention via lines 134 and 136 at appropriate time intervals T1, T2 and T3. The logic circuitry of the above identified Adamski, Jr. patent sequences the operation of the machine in the following periods or steps: (1) PRESEW (T1)—during which the workpiece is drawn through a folder apparatus (not shown), (2) TRANSITION (T2)—that period spanning the time between the beginning of the stitching cycle and the machines top running speed, and (3) SEWING (T3)—which extends for the duration of the sewing cycle. For a more detailed description of the sewing operations, the reader's attention is directed to the abovementioned Adamski, Jr. patent.

The servosystem of the present invention comprises a block or series of switch means 138 which may include the switches 140, 142, 144 and 146. Operably associated with the switches 142 and 144 is a block of adjustable means 148 which in the preferred embodiment may be comprised of potentiometer means 150 and 152 and which are employed to govern the feeding rate of the auxiliary mechanism 30 during the PRESEW (T1) and transition (T2) periods. At the onset of the sewing cycle, which begins with PRESEW, the logic circuitry generates a pulse over line 136. The presence of a pulse or signal over line 136 is effective to close switch 144 whereby allowing the preset value (V2) of adjustable means 152 to be fed via line 154 to a unity gain amplifier 155 which, in turn, delivers the preset value, via line 154, to the summing point of the servosystem generally indicated at 156 and whereat it represents a reference value for the system. The output signal (V1) of the sensing means 74 is also delivered to the summing point via line 130. The preset or reference value (V2) from the adjustable means 152 and the value (V1) from the sensing means 74 are algebraically combined at the summing point by any suitable means such as an error amplifier 158. These two signals, that is, the signal received from the sensing means 74 and the signal received from the potentiometer 152 are algebraically combined and the output or error signal (V5) from the error amplifier is amplified to a suitable level at the output of amplifier 160 and is delivered over lines 133 and 135 for application to control the speed of the servomotor 72 which, in turn, is effective to set or regulate the speed of the auxiliary feed mechanism. Hence, the feed rate of the auxiliary mechanism is modified until such time as the value from the sensing means 74 and the reference value from adjustable means 152 are equal.

When the PRESEW period (T1) times out, the logic circuitry removes the signal from line 136 and delivers a signal to line 134. The absence of a signal to switch 144 causes it to open whereby removing the signal delivered to the error amplifier by the adjustable means 152. As shown, line 134 can be connected as an input to a NAND gate 162. The signal from the logic circuitry enables the NAND gate 162 which, in turn, causes switch means 142 to close. The switch means 142 is associated with the adjustable means 150. Thus, when the switch 142 becomes closed, some predetermined signal or value V3 from the adjustable means 150, is fed through an adjustable means 240, the purpose of which will hereinafter be described, and acts as an input for a Digital to Analog Converter 170.

Figures 10B, 11:
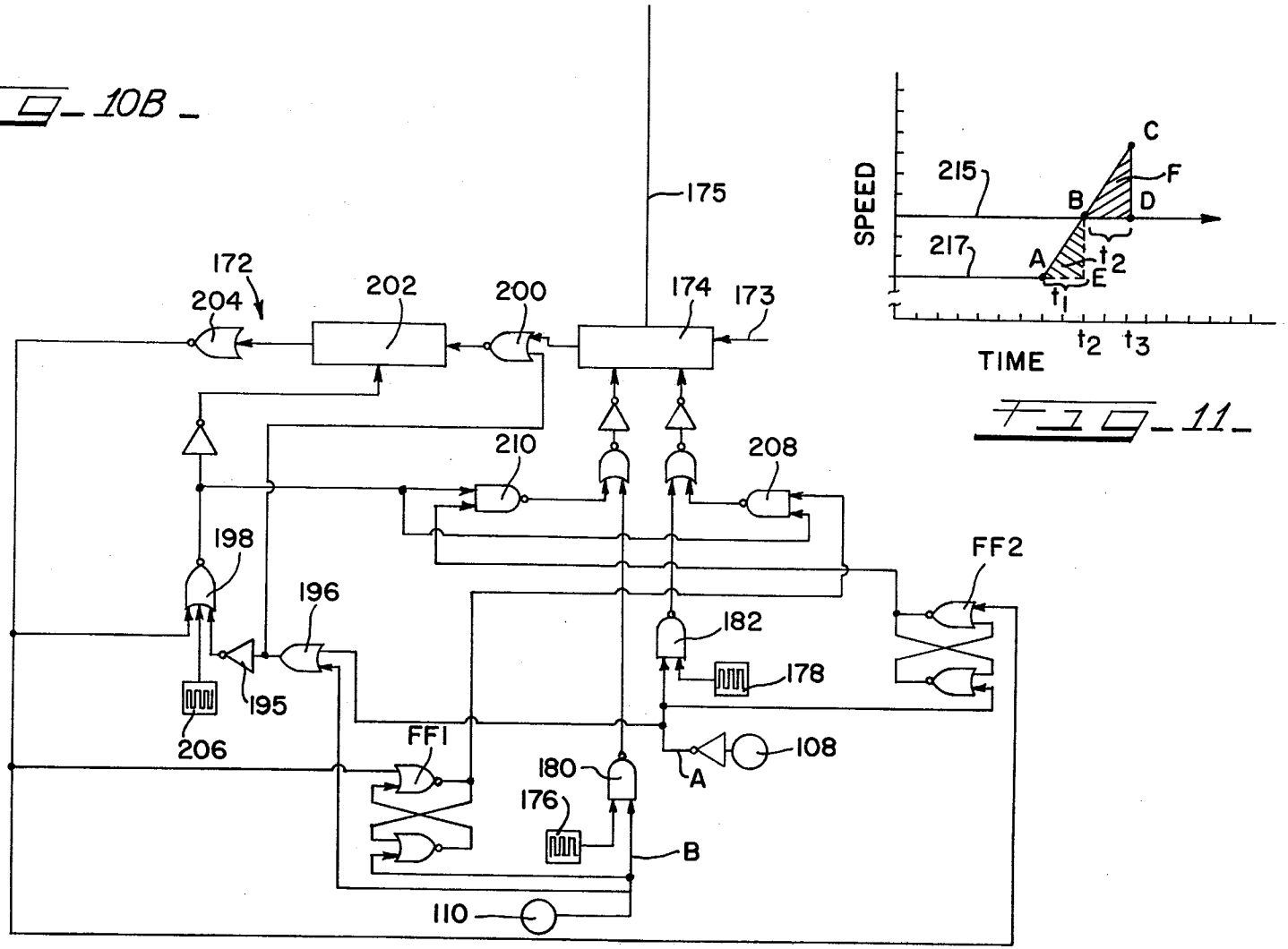
FIG. 11 is a graph illustrative of the variance in speed of the auxiliary feed mechanism.

Another input to the Digital to Analog Converter 170 may be derived from a unique positioning circuit 172 shown in FIG. 10B. The positioning circuit, in response to an enabling signal over line 173 from the logic circuitry of the machine, provides output signals over line 175 to the Digital to Analog Converter 170. Because of the nature of the operation of the machine in this embodiment, it is preferable to enable the positioning circuit only during the final period of sewing (T3). However with this embodiment, prior to enablization of the positioning circuit 172, a counter 174, which may be included in the circuit, is adapted to provide a reference signal (R1) to the Digital to Analog converter 170. This reference signal R1 may have a value equal to the value which was required in the last previous sewing operation to correct for lateral deviation of the workpiece edge or that which may be preset by the operator. The reference signal from the counter 174 and the value of adjustable means 150 are processed by the Digital to Analog converter in the following relationship:

$$R_1\left(\frac{V_3}{N}\right)$$

where N is some constant integer. Thus, during the transition period (T2) the output (Vo) of the Digital to Analog computer is:

$$V_o = R_1\left(\frac{V_3}{N}\right)$$

As may be noted from the showing of the servosystem 100 shown in FIG. 10 A while line 134 may be associated with the NAND gate 162 it may also be connected to the switch 146 via line 135. Thus, when a signal is delivered to line 134 it has the effect of closing switch 146. The output value (Vo) from the Digital to Analog converter is fed through the now closed switch 146 and may be delivered via lines 153 and 154, to the summing point 156 where it may act as a new reference voltage (R2) for the servosystem. This new reference voltage (R2) is representative of the desired speed of the feed device 58 during the TRANSITION period. The output or reference voltage may then be algebraically combined by the error amplifier with the signal (V1) received from the sensing means 74. As mentioned above, the error amplifier 158 sums the two signals and delivers a corrective or error signal, if any, to the servomotor 72 so as to vary the feed rate of the auxiliary mechanism accordingly.

At the same time as the impulse from the logic circuitry is delivered to the NAND gate means 162 via line 134 this impulse or signal may also be diverted to a time delay circuit 220 via line 222. The time delay circuit sets the duration (T2) for the TRANSITION period. As mentioned above, the duration of the TRANSITION period is dependent upon the extent of time it takes the machine to start up and reach its top sewing speed. It should be noted that there may be included with the time delay circuit 220 an adjustable means 224 which, for whatever reason, could allow the operator to vary the length of the transition period (T2). When the TRANSITION period times out, the time delay circuitry 220 disables gate 162 and thus the impulses delivered to switch 142 are removed therefrom thereby causing it to open. Once the switch 142 has been changed to its open position, the output of the adjustable means 150 (V3) is no longer delivered to the Digital to Analog Converter.

Upon the switching of the NAND gate 162, the time delay circuit 220 is effective to generate a signal over line 226 which in turn closes the switch 140. The closing of switch 140 allows a unique sewing machine speed measuring circuit 228 to now become effective. The measuring circuit may include a pulse width generator 230 which receives, via line 232, electric impulses from the sensing means 18. The impulses or signal from the sensing means 18 is representative of the speed of the motor which may be proportional to the speed of the machine 10. In effect, the sensing means 18 measures the speed of needle reciprocation and/or the feed rate of the feeding mechanism since both of these can be considered as a function of the speed of the motor. The pulse width generator 230 may be connected with an amplitude limiter 234 which may, in turn, be connected to an average integrator 236. As will be described below, the pulses produced by the measuring circuit 228 may be received by an adjustable means 221 which, in turn, delivers the signal (V4) produced by the motor measuring circuit 228 through the now closed switch 140, through the adjustable means 240 and to the Digital to Analog converter 170. Upon expriation of the TRANSITION period (T2) the logic circuitry enables the positioning circuit 172 by delivering a signal over line 173. The enablization of the positioning circuit 172 allows the counter 174 to produce an output signal having a value ($n_n$) the significance of which will be described hereinafter. The signal (V4) from the motor measuring circuit is processed by the Digital to Analog converter so that the output Vo has the following relationship:

$$n_n\left(\frac{V_4}{N}\right)$$

As discussed earlier, the output (Vo) of the Digital to Analog converter is fed through the still closed switch 146 and is delivered to the summing point 156 of the servosystem whereat it acts as a reference voltage and is algebraically combined with the signal from the sensing means 74 by the error amplifier 158. Throughout the continual running (T3) of the machine the speed of the motor and the speed of the auxiliary mechanism are compared. That is, during the sewing period (T3) the servosystem is adapted to "track" the speed of the machine 10. If the speed of the main drive motor 16 increases, a proportionately higher value (V4) will be produced by the motor measuring circuit 228. Consequently, when the error amplifier 158 senses a change in speed of the machine relative the speed of the auxiliary mechanism it automatically adjusts the feed rate of the mechanism 30 so as to compensate for the change in the speed of the machine.

As mentioned above, one advantage of the present invention is the possible detection of the lateral deviation of the workpiece edge beyond some predetermined range. To accomplish the above, the servosystem of the present invention has associated therewith the positioning circuit 172. As mentioned earlier, because of the nature of the operation of the machine, the positioning circuit is not enabled until the TRANSITION period has expired. However, once the TRANSITION period has timed out, the logic circuitry enables the positioning circuit 172 over line 173. Simply stated, the positioning circuit includes the UP/DOWN counter 174 which is capable of performing a memory function. Associated with the counter 174 are the "too fast" and "too slow" sensor elements 108 and 110 respectively, which jointly control the output ($n_n$) of the counter 174 in a manner described in detail hereinafter. Also included in the positioning circuit 172 are pulse generators or oscillators 176 and 178 which are gated to the counter 174 through NAND gates 180 and 182 respectively. With the embodiment shown in FIG. 10B a signal from the sensor 108 on line A controls the gating of pulses to cause the counter 174 to count DOWN, while a signal from the sensor 110 over line B controls the gating of pulses to cause the counter 174 to count UP.

Prior to the positioning circuit becoming enabled, the value held in the memory function of the counter 174 has some measurement or count ($n_1$) that it has retained from the previous operation. It is this count which is delivered to the Digital to Analog converter 170 as the reference number ($R_1$) during the TRANSITION period. The value associated with the count $n_1$ is equal to that corrective value which was needed in the previous sewing operation, or as set by the operator, to adjust or set the feed rate of the auxiliary mechanism relative the velocity of the workpiece so that the workpiece edge will be urged to remain in its predetermined path of travel. Upon enablization of the positioning circuit, the initial output $n_n$ of the counter 174 will be equal to $n_1$ and as long as the workpiece edge remains substantially in registration with the predetermined path, defined by the limits set by the mechanical spacing of the sensor elements, there should be no change in the count $n_1$ presently held by the counter. Thus the output $n_n$ of the counter remains equal to $n_1$. As mentioned, during the entirety of the sewing (T3) period, the output signal $n_n$ of the counter is processed with the value V4 from the machine speed measuring circuit 228 in the following relationship $$n_n\left(\frac{V_4}{N}\right)$$

The sensing elements 108, 110 are adapted to monitor the position of the workpiece edge relative its predetermined path. If the workpiece edge should traverse beyond the predetermined range, set by the spacing of the sensors, the associated sensor which detects movement beyond the set limit changes state. The change of state of the sensor causes the associated oscillator to initiate pulsing to the counter 174 thus changing the output ($n_n$) value produced by the counter 174. The change in the output of the counter 174 may be proportionately translated into a change in the output of the Digital to Analog converter 170 thus resulting in a change in the feed rate of the auxiliary mechanism. It is important to note that the positioning circuit is only effective to change the feed rate of the auxiliary mechanism and does not change the feed rate of the machine 10. The change in the feed rate of the auxiliary mechanism 30 relative to the velocity of the workpiece results in a tension or component force vector being applied to the workpiece in the area between the presser foot and the roller 58 thus urging the workpiece edge into registration with the predetermined path.

OPERATION OF THE MACHINE

It should be appreciated that prior to the start of the sewing cycle the feed roller is in the position shown in FIG. 3. Upon initiation of the sewing cycle the logic system of the machine actuates the force driver 60 whereby moving the feed device 58 into the position shown in FIG. 4. At the same time as the force driver 60 is actuated, a signal over line 136 closes switch 144. The closing of switch 144 allows the preset value (V2) of the adjustable means 152 to be fed to the summing point 156 whereat it acts as a reference signal for the system and is combined with the value (V1) received from the sensing means 74. Since at this time the servomotor has not yet begun to pull the workpiece the value (V1) received from the sensing means 74 is zero. As described above, the two signals (V1 and V2) are summed by the error amplifier 158 and the error voltage, if any, is amplified to a suitable level at the output of amplifier 160 for application to control the speed of the servomotor 72 and thus the feed rate of the auxiliary mechanism. So long as the logic circuitry supplies a signal over line 136, the preset value V2 of the adjustable means 152 is effective to control the feed rate of the auxiliary mechanism. As has been said, the preselected value V2 is effective to cause the roller 58 to pull the workpiece through the folder assembly at a predetermined speed during the PRESEW portion of the sewing cycle.

The motor 72 may continue to run at the predetermined presew speed until such time as the PRESEW period times out. Automatically following the expiration of the PRESEW period, suitable means are arranged to remove that portion of the workpiece edge, located between the presser foot 25 and the feed roller, from its normal path of travel. At the same time, the logic system removes the signal from line 136 and directs a signal over line 134 resulting in the closure of switches 142 and 146. It will be appreciated that the lack of a signal over line 136 allows switch 144 to return to its normal open position thus preventing the value V2 of adjustable means 152 from reaching the summing point 156 of the servosystem. However, the closure of switch 142 allows the preset value (V3) from the adjustable means 150 to be delivered to the Digital to Analog converter 170 whereat it is processed with the reference number R1 from the counter 174 in the relationship $$R_1\left(\frac{V_3}{N}\right)$$

so as to control the speed of the feed roller 58 during the TRANSITION period.

Figure 6:
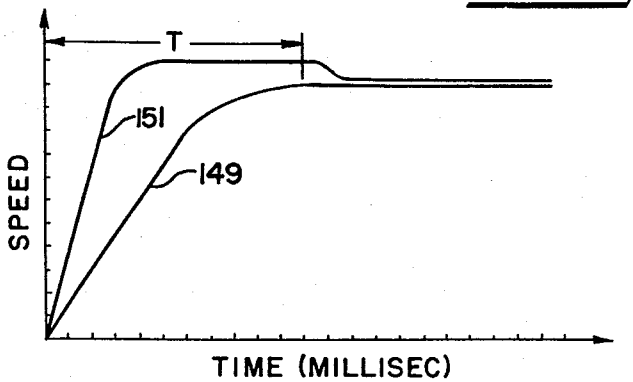
FIG. 6 is a graph of the speed of the main drive motor and the variable speed motor associated with the present invention.

Turning to FIG. 6, there is shown a speed/time graph which schematically compares the speed of the auxiliary feed device (represented by line 151) with the speed of the motor 16 (represented by line 149). The duration of the TRANSITION period is represented by the letter "T". From the graph it is apparent that during the TRANSITION period the speed of the feed mechanism 58 may not only be in excess of the speed of the motor but it is also developed at a quicker rate. Even though the feeding direction of the auxiliary device may be parallel or colinear with the feed direction of the main feed mechanism, the difference in the feed rate velocities creates a pulling or stretching tension on that portion of workpiece situated between the feed roller 58 and the main feed mechanism of the machine. It is this tension or stretch which causes the edge of the workpiece to search for the shortest distance between the feed roller 58 and the feed mechanism thus resulting in the laterally displaced edge returning to its predetermined path of travel.

Once the transition period has timed out, and the initially displaced portion of the workpiece has been realigned the switch means 142 is opened and switch 140 becomes closed thus allowing the machine to move into the SEWING period (T3) which extends for the duration of the sewing cycle. During the SEWING period the feed device 58 "tracks" the speed of the motor 16 as was discussed. Also, with the preferred embodiment, following the expriation of the TRANSITION period, the logic circuitry may enable the positioning circuit 172 over line 173 such that any lateral deviation of the workpiece edge, resulting from a change in characteristics of the work being sewn or other factors, may be monitored by the sensors and thus corrected for in the methodical manner described above. As one may appreciate, by maintaining the workpiece edge within a very limited range on the rearward side of the needle, it may effect the position of the edge in advance of the stitch forming instrumentality.

Assume for whatever reason that the "too slow" sensor 110 detects lateral deviation of the workpiece beyond the predetermined range. The detection of the lateral deviation is indicative of either a change in the sewing characteristics of the workpiece or some other force may be acting on the workpiece. Whatever the cause, upon detection of the lateral deviation the "too slow" sensor changes state thus indicating to the servosystem 100 a need for a correction in the speed of the auxiliary mechanism relative the velocity of the workpiece. Such a change of state by sensor 110 enables gate 180 thus allowing the oscillator 176 to increment the count $n_1$ of the counter 174. During the interim that the sensor detects lateral deviation of the workpiece edge, the count $n_1$ held in the memory or storage location of the counter is incremented by the oscillator 176 such that the output $n_n$ of the counter 174 is equal to $n_1+n_2$ where $n_2$ equals the number of pulses produced by the oscillator 176 as a function of the amount of time the sensor 110 is in its changed state. As mentioned, a change in the $n_n$ or output value of the counter 174 results in a proportional change in the output (Vo) of the Digital to Analog Computer 170 which may be translated into a variance in the feed rate of the auxiliary mechanism 30. However, the change in the speed of the auxiliary mechanism does not effect the feed rate of the main feed mechanism of the machine 10. Thus, a change in the feed rate of the auxiliary mechanism relative the velocity of the workpiece results in a component force vector being applied to the workpiece whereby causing the workpiece edge to move toward the predetermined path 114 or range. Once the workpiece edge has been urged within the predetermined range by the auxiliary feed mechanism the sensor 110 no longer detects any deviation and therefore the sensor returns to its normal state thus disabling gate 180 whereby interrupting the flow of counts or pulses from the oscillator 176 to the counter 174 and thus preventing any further change in the output value $n_n$ of the counter 174.

Conversely, if the feed rate of the auxiliary mechanism relative the velocity of the workpiece is "too fast" the workpiece may be laterally shifted in the opposite direction. Such lateral shifting may change the state of the "too fast" sensor thus enabling gate 182 whereby allowing the oscillator 178 to effect the output value $n_n$ of the counter 174 in the following relationship: $n_n=n_1-n_2$. In the same manner as described above, a change in the output value $n_n$ of the counter causes the Digital to Analog converter to produce a signal Vo which is indicative of a need for a change in the speed of the auxiliary mechanism relative the velocity of the workpiece. As described earlier, a change in the feed rate of the auxiliary mechanism relative the velocity of the workpiece imparts a force on the workpiece thus causing the workpiece edge to laterally shift toward its predetermined path. Once the sensor detects that the workpiece edge has returned within the limits of the predetermined range, it disables gate 182 thus preventing any further change in the output value $n_n$ of the counter 174.

From the foregoing description it is apparent that the sensors 108, 110 are utilized to continually monitor the position of the workpiece edge as well as to aid in the correction of the lateral deviation of the edge beyond some predetermined range. In addition to the above, it has been found desirable to provide means which automatically adjust the feed rate of the auxiliary mechanism so that it may not overcorrect for the lateral deviation of the workpiece edge.

Assume, that the velocity or surface speed of the workpiece is greater than the feed rate of the auxiliary mechanism 30. In FIG. 11 the velocity of the workpiece is schematically represented as line 215 and the feed rate of the auxiliary mechanism is represented at 217. In this case, the lateral deviation of the workpiece edge, resulting from the difference between the velocity of the workpiece and the feed rate of the mechanism 30, will be detected by the "too slow" sensor. At point A in FIG. 11 the positioning circuit is enabled thus allowing the "too slow" sensor to detect the lateral deviation of the workpiece edge and accordingly allows incrementation of count $n_1$ held by the counter 174 thus resulting in an increase in output $n_n$ and whereby changing the speed of the auxiliary mechanism in the manner described above. As is apparent, the speed of the auxiliary mechanism increases and at point B the velocity of the workpiece and the feed rate of the auxiliary mechanism are equal. However, the simple matching of the two speeds may not suffice to return the displaced workpiece edge (schematically represented as shaded area E) to its predetermined path. In addition, at point B the speed of the auxiliary mechanism and the velocity of the workpiece may be approximately equal but the speed of the auxiliary mechanism has not sufficiently been modified so as to create a tension or component force vector on the workpiece and thus the edge will not be returned towards its predetermined path. Since the edge has not been displaced to within the predetermined limits set by the sensors, the "too slow" sensor continues to reflect or indicate a need for change in the speed of the auxiliary mechanism relative the velocity of the workpiece. Accordingly, the positioning circuit further modifies the speed of the auxiliary mechanism until point C is reached. At point C the speed of the auxiliary mechanism relative the velocity of the workpiece has been modified such that it is sufficient to apply a component force vector to the workpiece and thus return the displaced workpiece edge toward its predetermined path. The return of the edge is sensed by the "too slow" sensor and, as a result, the positioning circuit no further increments the speed of the mechanism 30.

As is apparent, if the positioning circuit 172 were to allow the speed of the auxiliary mechanism to remain at level C the operator would encounter problems of workpiece oscillation commonly known as hunting, resulting from the workpiece edge oscillating between the sensor 108 and 110. Such a phenomena is clearly undesirable with a machine as described in the Adamski, Jr. patent in that such oscillation or hunting may result in various widths of the hem. Thus, it was necessary to design the positioning circuit so that once the speed of the auxiliary mechanism has been sufficiently modified to compensate for the displaced workpiece edge (represented by shaded area F) the speed of auxiliary mechanism is further modulated to point D whereat the velocity of the workpiece and the speed of the mechanism 30 are generally equal whereby maintaining the workpiece edge within the predetermined range.

To accomplish the required speed changes for the auxiliary mechanism the circuit 172 shown in FIG. 10B includes means to modify the speed of the auxiliary feed mechanism in a manner similar to that discussed above. Since both sensors 108 and 110 work in substantially the same manner the monitoring of the workpiece edge by sensor 110 and its associated circuitry will be discussed as representative in connection with FIG. 10B. As described above, sensor 110 is connected to the counter 174 and once the sensor 110 is allowed to detect the lateral deviation of the workpiece edge (point A on FIG. 11) the gate 180 becomes enabled so as to allow pulses or counts $n_2$ from the pulse generator 176 to increment the output value $n_n$ of the counter 174 whereby altering the speed of the auxiliary feed mechanism. As shown, the output of the sensor 110 may also be connected to a flip flop FF1. Upon detection of the lateral deviation of the workpiece edge the sensor 110 sets the flip flop FF1. The output of the sensor 110 may also be connected as an input to an OR gate 196. Connected to the output of gate 196 via an inverter 195 are NOR gates 198 and 200. As mentioned above, when the sensor detects the lateral deviation of the workpiece edge it changes state. The change of state is sensed by gate 196 which, in turn, enables gate 200 and disables gate 198. Once gate 200 is enabled, a count equal to $n_n/2$ is delivered to a second UP/DOWN counter 202 whereby causing it to count UP from a zero value. Connected to the output of counter 202 is a NOR gate 204 which produces a signal when there is a count $\geqq 1$ present in the counter 202. The output of the gate 204 acts as an input for: (1) the NOR gate 198, (2) the flip flop FF1, and (3) the flip flop FF2.

As long as sensor 110 detects the lateral deviation of the workpiece edge the $n_n$ value of the counter will be incremented and the speed of the auxiliary mechanism will be modified accordingly. The speed of the mechanism 30 will be modified until such time (point C on FIG. 11) as the relative speeds of the feed mechanism are adjusted sufficiently so that the workpiece edge will be urged back into registration with its predetermined path. Once the edge is returned to within predetermined range, the sensor returns to its normal state whereby disabling gate 180 and consequently interrupting the flow of counts $n_2$ to the counter 174. Also, when the sensor 110 detects that the workpiece edge has been returned within the predetermined range, it changes the state of gate 196 and thus disables the NOR gate 200. By disabling gate 200, the flow of counts $n_2$ to the counter 202 is interrupted. At the same time, the change of gate 196 allows gate 198 to become enabled. Connected as an input to gate 198 is a oscillator 206 which, once the gate 198 is enabled, is effective to count DOWN the count $n_n/2$ presently held in the counter 202. The output of gate 198 is also connected as an input to NAND gates 208 and 210. The NAND gate 210 is connected to the output of flip flop FF2 while the NAND gate 208 is connected to the output of flip flop FF1. In this manner, the signal produced by gate 204 when combined with the change of state of the associated sensor "locks out" either the "too fast" or the "too slow" portion of this positioning circuitry. With the present example, the signal from sensor 110 sets the flip flop FF1 such that its output enables gate 208. The flip flop FF2 cannot be set as it is physically impossible for the workpiece to both uncover sensor 110 and cover sensor 108. Thus gate 210 is not enabled. Hence, when the counts from the oscillator 206 are presented at both gates 208 and 210 only the enabled gate, which in present example is 208, allows passage of the count to the counter 174. With the present example, the count from 206 passes through gates 198 and 208 and is effective to count DOWN the count presently held in the counter 202, thus reducing the output $n_n$ of the counter 174 by generally one-half the increase imparted to counter 174 and consequently varying the speed of the auxiliary mechanism to such an extent that it generally equals the velocity of the workpiece (point D on FIG. 11).

Once the count in the counter 202 is reduced to O, through the subtraction of the pulses from oscillator 206, the gate 204 changes state. The change of state of gate 204 disables gate 198 thus preventing any further pulses or counts from the oscillator 206 to be produced at the output of gate 198 whereby preventing any further decrease in the count of the counters 174 and 202. The change of state of 204 further resets the flip flop FF1 so as to disable gate 208 thus returning the positioning circuit to a state such that either sensor is rendered effective to modify the speed of the auxiliary mechanism upon detection of the lateral deviation of the workpiece edge.

It has been found that the movement and correction for the lateral deviation of the workpiece edge is generally symetrical with respect to time. That is, during the lateral deviation of the workpiece edge it takes some time ($t_1$) for the edge to traverse beyond the predetermined range and it takes a generally equal amount of time ($t_2$) to forcibly urge the edge back into alignment with the predetermined path. Based on this observation, the count produced by the counter 174 is analogous to the total amount of time ($t_1+t_2$) that it takes to correct for the lateral deviation of the workpiece edge. In accordance with the symetrical movement of the workpiece, it was found that one half the total count was sufficient to maintain the workpiece edge into registration with its predetermined path of travel and therefore a value equal to $n_n/2$ may be delivered to the counter 202. In this manner the corrective count or measurement produced by the counter 174 is modified by approximately one half so as to account for the symetrical features inherent with the present invention.

Figure 10A:
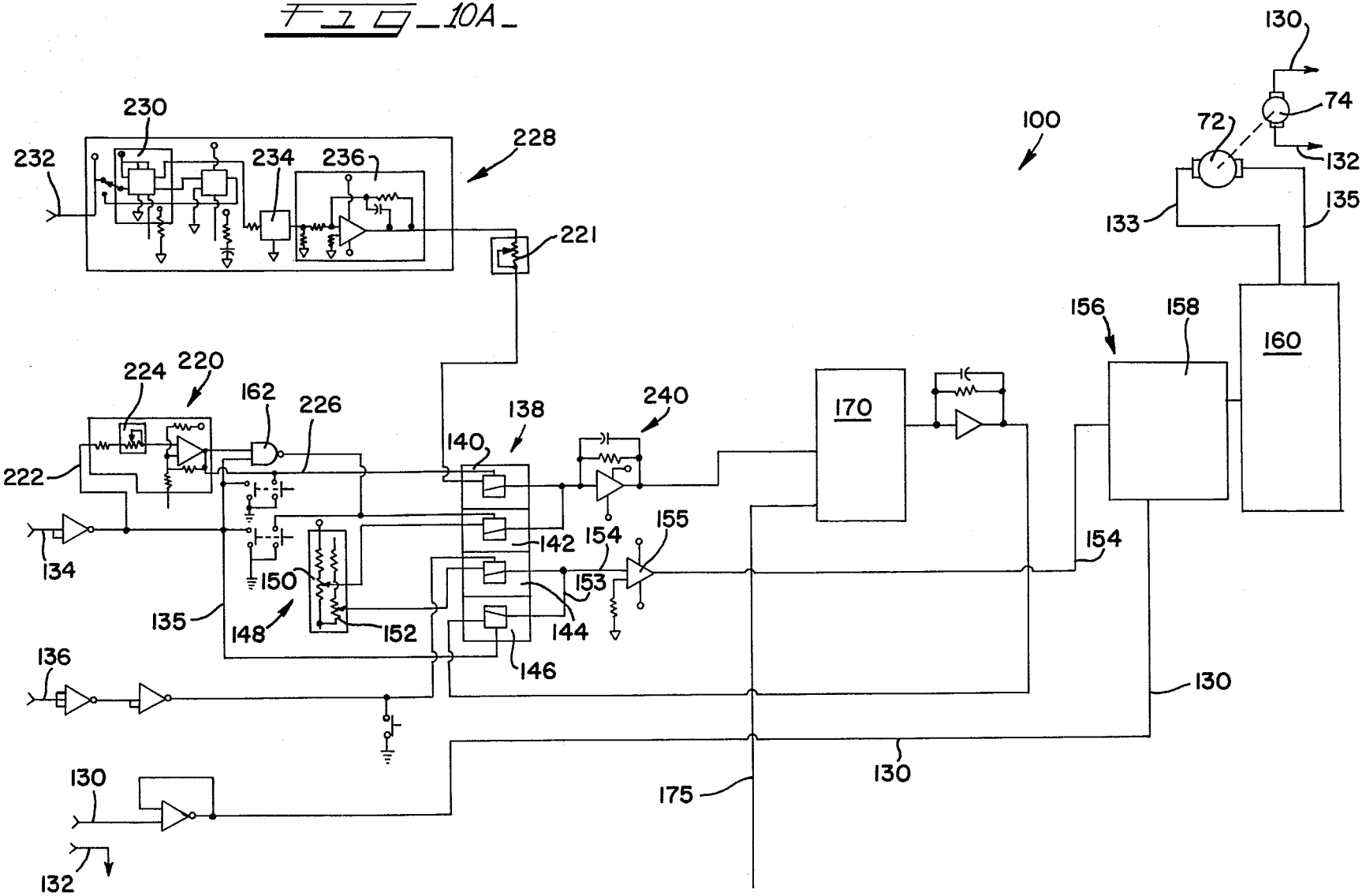
FIGS. 10 A & B are schematic views of the electrical system associated with the present invention.

As shown in FIG. 10A, interposed between the switches 140, 142 and the Digital to Analog Converter 170 may be an adjustable means generally indicated as 240. The adjustable means 240 allows the operator to manually adjust the servosystem for expectant changes in the feeding characteristics. Since a drastic change in the stitch length or in the feeding characteristics of a material will be reflected both during the TRANSITION and SEWING periods, the adjustable means may be disposed intermediate the switches 140 and 142 so as to compensate during both periods. When the operator is advised of the expectant change, it is possible to modulate the adjustable means 240 so as to manually compensate for the expectant change in workpieces. Once adjusted the operator can quickly visually check the degree of adjustment by reviewing the position of the workpiece edge relative its predetermined path by comparing the position of the edge relative the slot 59 on the guide 57 during the transition period. The incorporation of the adjustable means 240 within the servosystem 100 allows for a manual adjustment of the speed of the auxiliary mechanism 30 when major changes, i.e., a drastic change in stitch length, speed, etc., are made to the machine.

An embodiment of the invention has been described above which may suitably maintain the edge of a tubular workpiece in registration with a predetermined position or path as well as to concomitantly aid in the advancement of the workpiece through the workstation. However, it should be noted that the use of any sequence of operations, as opposed to that described above, may entirely be possible without deviating from the scope of the present invention. Also, while the specific system described herein has been described with respect to the use of UP/DOWN counters, pulse generators and Digital to Analog converters, obvious modifications in the system may be made so that the device could automatically electronically respond to signals from apparatus which are associated with other types of electronic devices which are known in the art and, may be, by way of example, a micro-processing device of the type manufactured and sold by Intel Corporation under Model No. 8080.

Thus it is apparent that there has been provided an Auxiliary Feed Mechanism for Sewing Machines which fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. In a sewing machine having means for performing operations upon an edge of a workpiece, logic circuitry for operating said machine, first feed advancing means operative to move the edge of said workpiece past said performing means and an auxiliary feed mechanism comprising:

second feed advancing means arranged rearward of said first feed advancing means for creating a tension zone therebetween through which the workpiece travels;

variable speed drive means adapted to drive said second feed advancing means at an adjustably regulated feed rate;

sensor means arranged rearward of the performing means and adapted to provide an indication of the lateral position of said workpiece edge; and means for operating said variable speed drive means under the control of said sensor means and said logic circuitry so as to vary the degree of tension in said tension zone whereby maintaining the edge of said workpiece in a predetermined position relative to said performing means.

2. The auxiliary feed mechanism of claim 1 wherein said means for operating further includes means connected to said sensor means for producing a control signal having electrical characteristics which are variable in accordance with the output received from said sensor means.

3. In a sewing machine having stitch forming means for operating on an edge of a tubular workpiece, a workpiece constraining means, logic circuitry for operating said machine in preselected time sequences, and an apparatus for advancing the workpiece comprising:

feed mechanism means engageable with the sewn edge of the workpiece at localities spaced rearwardly of and in general alignment with the stitch forming means in the direction of feed for moving the edge of said workpiece past said stitch forming means;

motor means adapted to drive said feed mechanism means at a regulated feed rate;

sensor means capable of generating variable command signals commensurate with the desired lateral position of the sewn edge relative said needle; and means for modulating the feed rate of said mechanism means by said command signals and said logic circuitry so as to maintain the sewn edge in said desired position while the workpiece is being advanced whereby effecting the position of the edge yet to be sewn.

4. In a sewing machine operable under the control of a logic circuitry for performing an operation upon an edge of a workpiece comprising:

needle means adapted to operate along the edge of a workpiece;

a first feed advancing means operative to move the workpiece past said needle means;

second feed advancing means arranged rearward of the first feed advancing means and adapted to create a tension zone through which said workpiece edge travels;

drive means adapted to move said second feed advancing means at a regulated feed rate;

sensor means arranged rearward of the needle means so as to provide an indication of the position of said workpiece edge relative said needle means; and means for operating said drive means under the control of said sensor means and said logic circuitry and adapted to regulate the tension on said workpiece edge as it is advanced through said tension zone whereby maintaining said edge in a predetermined position with respect to said needle means.

5. In a sewing machine having a stitch forming instrumentality, means for supporting a workpiece, a first work advancing means adapted to feed the edge of the workpiece along a predetermined path, logic circuitry operative to actuate said machine in a predetermined sequence, and an auxiliary feed mechanism comprising:

second work advancing means arranged relative to the first advancing means such that the workpiece edge is subject to tension between the respective work advancing means;

two or more sensor means capable of producing a signal indicative of lateral deviation of the workpiece edge relative the predetermined path as said workpiece is being advanced; and means responsive to said logic circuitry for controlling the feed rate of said second work advancing means relative said first work advancing means and adapted to vary the feed rate of said second work advancing means relative the first work advancing means in response to a signal from said sensor means thereby varying the tension imparted on said workpiece edge so as to bring the edge of the workpiece substantially in line with said predetermined path.

6. The invention according to claim 5 wherein said means responsive further includes means for measuring the magnitude of the lateral deviation of the workpiece relative to the predetermined path.

7. A sewing machine for stitching along the edge of a tubular article, said sewing machine including a work support means, stitch forming instrumentality means, a first work feeding means, and an auxiliary feed mechanism comprising:

second work feeding means arranged at localities spaced directly rearward of the stitch forming instrumentality for exerting a steering motion to said workpiece;

sensing means arranged rearward of the stitch forming instrumentality means in the direction of feed and adapted to provide an output signal having a value indicative of the position of the sewn edge of the article; and control means responsive to the output signal of said sensor means for adjusting the relative feed rate of said second work feeding means relative said first work feeding means so as to control the position of the sewn edge relative some predetermined position whereby effecting the position of the edge of the tubular article yet to be sewn.

8. The invention of claim 7 wherein said sensing means includes at least two sensor units a first of which has an operative position spaced to one side of said predetermined position and the second of which is spaced to the other side of said predetermined position.

9. In a machine for performing operations upon an edge at a workpiece, said machine including a tool, a logic circuitry for operating said machine, a first work feeding means for advancing the edge of the workpiece along a predetermined line of feed and an apparatus for concomitantly advancing the workpiece past said tool comprising:

second work feeding means including feed roller means whose longitudinal axis is desposed substantially perpendicular relative to the direction of feed;

means for mounting the second work feeding means rearward of the tool for bearing against the workpiece, said mounting means being adapted to maintain a stationary relationship between the disposition of said feed roller and the direction of feed;

a plurality of sensor means arranged to produce a signal in response to lateral deviation of the workpiece edge;

means deriving a signal from said sensor means and operative to produce a signal having a value reflective of the position of the workpiece edge relative said predetermined line of feed; and a servosystem operatively associated with said logic circuitry and said means operative for varying the relative feed rates of said first and second work feeding means so that said workpiece is subjected to various levels of tension between the respective work feeding means, the tension being imparted to said workpiece being effective to urge the workpiece edge into alignment with said predetermined line of feed in response to signals from said sensor means.

10. In combination with a sewing machine having stitch forming instrumentalities, logic circuitry for sequencing the operation of the machine, main feed means for advancing a workpiece past said stitch forming instrumentalities and an apparatus for maintaining the edge of the workpiece in a desired position, said apparatus comprising:

motor driven auxiliary feed means arranged substantially rearward of the main feed means;

control circuitry means arranged independent of the sewing machine and operable in response to signals from the logic circuitry, said control circuitry means including means adapted to set the speed of the auxiliary feed means relative to the main feed means;

sensing elements mounted rearward of the stitch forming instrumentalities for detecting lateral deviation of the workpiece edge beyond a predetermined range and capable of producing a signal in response thereto; and positioning circuitry means arranged in association with said sensing elements and said control circuitry means for intermittently altering the set speed of said auxiliary feed means as a function of the position of said edge relative said desired position.

11. An apparatus as set forth in claim 10 wherein said positioning circuitry means includes means adapted to measure the magnitude of the lateral deviation of the workpiece edge relative said desired position, said control circuitry means being responsive to said measuring means.

12. In combination with a sewing machine having stitch forming instrumentalities, logic circuitry for sequencing the operation of the machine, main feed means for advancing a workpiece past said stitch forming instrumentalities and an apparatus for maintaining the edge of the workpiece in a desired position, said apparatus comprising;

motor driven auxiliary feed means;

control means operable in response to signals from the logic circuitry for controlling the speed of the auxiliary feed means relative the main feed means;

sensing elements mounted laterally on either side of the desired position for detecting lateral deviation of the workpiece edge beyond a predetermined range and capable of producing a signal in response thereto; and positioning means operably associated with said sensing elements and arranged in circuit relationship with said means for altering the speed of said auxiliary feed means as a function of the position of said edge relative said desired position, said positioning means includes, measurement means comprising counter means for registering the magnitude of the lateral deviation of the workpiece edge, said counter means being adapted to accumulate a count analogous to the time period between the detection of and correction for the lateral deviation of the workpiece edge.

13. An apparatus according to claim 12 wherein said accumulated count is approximately equal to the time period required to vary the speed of the auxiliary feed means.

14. An apparatus according to claim 12 wherein said positioning means further includes a second counter adapted to accumulate a count approximate one-half the count accumulated by the other counter, said second counter being effective to further modulate the speed of said auxiliary feed means.

15. An apparatus according to claim 12 further including means responsive to said measuring means for effecting the movement of the workpiece once the speed of the second work feeding means has been altered to correct for the lateral deviation of the workpiece.

16. In combination with a sewing machine having means forming stitches in a workpiece, main feed mechanism means adapted to advance said workpiece along a predetermined path of travel, logic circuitry for sequentially operating the machine and an apparatus for maintaining an edge of the work in a predetermined position comprising:

motor driven auxiliary feed means engageable with the workpiece and tandemly arranged with respect to the main feed mechanism means so as to create a tension zone therebetween;

means responsive to said logic circuitry and effective to produce an output signal having a value in accordance with the speed of the machine;

first means operative to produce a signal representative of the speed of the auxiliary feed means;

second means operative to produce a signal representative of the position of the workpiece edge relative the predetermined position;

signal processing means responsive to the signal from said means responsive and to the signal from said second means operative and effective to produce a signal having a value related to certain characteristics of the workpiece being sewn and to the position of the workpiece edge, said produced signal controlling the amount of tension imparted to said workpiece as it travels through said tension zone so as to effectively position the workpiece edge;

means for summing the signals from said signal processing and said first means operative and for varying the speed of the auxiliary feed device in accordance with their summation whereby effecting the position of the workpiece edge relative said predetermined path.

17. Apparatus as claimed in claim 16 wherein said signal processing means includes a digital to analog converter means.

18. Apparatus as claimed in claim 16 wherein said second means operative includes a pair of photoreflective sensor displaced on either side of said predetermined position, said workpiece masking one of said sensors when in its predetermined position.

19. Apparatus as claimed in claim 16 wherein said second means operative includes means responsive to lateral deviation of the workpiece edge in one direction relative the predetermined path of travel and means responsive to the lateral deviation of the workpiece edge in the other direction.

20. Apparatus according to claim 19 wherein said means responsive includes at least one photoreflective sensor means.

21. In combination with a machine having a tool for operating upon the edge of a workpiece, a logic circuitry, means for feeding the workpiece past said tool and an apparatus for maintaining the workpiece edge in a predetermined position relative to said tool, said apparatus comprising:

a motor driven auxiliary feed means disposed in the line of feed and arranged to impart a concomitant collinear motion to said workpiece, said collinear motion being effective to create tension on said workpiece in an area between said tool and said auxiliary feed means;

means responsive to signals from said logic circuitry for actuating said auxiliary feed means; and a control system which is responsive to lateral deviation of the workpiece edge from said predetermined position including means for intermittenly driving said auxiliary feed means at variable speeds relative the velocity of the workpiece so that varying degrees of tension may be exerted to the workpiece whereby shifting the edge of the work laterally in a direction toward said preselected position.

22. In combination with a sewing machine having means for forming stitches along the edge of a workpiece, means operative for feeding the workpiece edge along a predetermined path, logic circuitry for sequencing the operations of the machine and an apparatus for concommitantly aiding the advancement of the workpiece and capable of sensing certain characteristics of the work being sewn comprising:

motor driven auxiliary feed means tandemly arranged relative to said means operative for imparting a collinear concomitant feeding motin to said workpiece, said collinear motion having the effect of imparting tension to said workpiece as it is advanced between said means operative and said auxiliary feed means;

means for detecting the disposition of the workpiece edge relative said predetermined path resulting from a change in the characteristics of the workpiece being sewn;

a servosystem operable in response to signals from said logic circuitry for controlling the speed of, the auxiliary feed means relative the speed of the feeding means; and means coupled to said detection means and responsive thereto for generating a signal to said servosystem upon receipt of an indication from said detection means of a change in the characteristics of the workpiece being sewn relative the last workpiece sewn, said signal being effective to adjust the speed of the auxiliary feed means relative the velocity of the workpiece so as to modulate the degree of tension being imparted to said workpiece according to the lateral displacement at the workpiece edge whereby compensating for the change in the characteristics of the work being sewn.

23. The method of retaining a workpiece edge in registration with its normal feed path during movement of the workpiece through a machine comprising the steps of:

feeding the workpiece along a normal feed path;

imparting tension to said workpiece edge along a line generally collinear with the direction of workpiece advancement;

monitoring the position of said tensioned workpiece edge relative to said normal feed path;

varying the tension imparted to said workpiece edge independently of the machine when same deviates from its normal path of travel whereby urging the workpiece edge toward its normal feed path.

24. The method as recited in claim 23 further including the step of further modulating the tension being imparted to said workpiece edge once the deviation of the workpiece edge has been corrected for.

25. In a machine having a work station defined by a tool for operating progressively on an edge of a tubular workpiece, said machine including a work advancing mechanism and a logic circuitry for operating said machine, an automatic work feeding and guidance mechanism for controlling the position of the edge as it leaves the work station so as to present the remaining unworked edge to the tool along a predetermined path, said work feeding and guidance means comprises:

motor driven variable speed drive means including a member arranged directly rearward of the tool and frictionally engageable with the workpiece so as to create a tension zone between the work advancing means and said member;

sensor means arranged rearward of the tool in the direction of feed and positioned on opposite sides of the workpiece edge;

first operative means for operating said variable speed drive means in response to said logic circuitry; and second operative means actuated by covering and uncovering movement of the flat workpiece relative the sensor means as the material is fed past the tool, said second operative means being effective to modulate the speed of the variable speed drive means relative the velocity of the workpiece so as to adjust the tension of said workpiece as is passes through said tension zone whereby altering the position of the sewn workpiece edge.

* * * * *